US008292762B2

(12) United States Patent
Clancy

(10) Patent No.: US 8,292,762 B2
(45) Date of Patent: Oct. 23, 2012

(54) HOCKEY STICK HANDLE

(76) Inventor: Brian T. Clancy, Oxford, MI (US)

( * ) Notice: Subject to any disclaimer, the term of this patent is extended or adjusted under 35 U.S.C. 154(b) by 0 days.

(21) Appl. No.: 12/615,043

(22) Filed: Nov. 9, 2009

(65) Prior Publication Data

US 2010/0120561 A1 May 13, 2010

Related U.S. Application Data

(60) Provisional application No. 61/112,484, filed on Nov. 7, 2008.

(51) Int. Cl.
*A63B 59/14* (2006.01)

(52) U.S. Cl. ..... 473/560

(58) Field of Classification Search ..... 473/560–563
See application file for complete search history.

(56) References Cited

U.S. PATENT DOCUMENTS 4,351,528 A * 9/1982 Duplin ..... 473/560
4,553,753 A * 11/1985 Gibbons ..... 473/560
6,004,234 A * 12/1999 Majchrowicz ..... 473/560
6,248,031 B1 * 6/2001 Brodie ..... 473/560
6,364,792 B1 * 4/2002 Evanochko ..... 473/560
7,288,036 B2 * 10/2007 Casasanta, Jr. ..... 473/560
7,568,987 B2 * 8/2009 Mayer ..... 473/560

FOREIGN PATENT DOCUMENTS

CH 685149 A5 * 4/1995

* cited by examiner

*Primary Examiner* — Mark Graham
(74) *Attorney, Agent, or Firm* — John A. Artz; Dickinson Wright PLLC

(57) ABSTRACT

A hockey stick handle is provided for use with a hockey stick shaft including an upper shaft surface having an upper shaft plane, a lower shaft surface having a lower shaft plane, two side shaft surfaces having side surface planes and a shaft centerline. The handle includes a shaft engagement end, a handle termination end opposite thereto, an upper handle surface, a lower handle surface comprising a lower surface spline extending inwards from the lower shaft plane towards the upper shaft plane in a first lower handle surface beginning at the shaft engagement end. The lower surface spline extending outwards in the lower shaft plane direction in a second lower handle surface beginning at the first lower handle surface and extending towards the handle termination end. A curved stop element runs between the upper handle surface towards the lower handle surface at the handle termination end and is sized to fit within a human palm. Two handle side surfaces run generally parallel to the two side shaft surfaces. The lower surface spline is configured to provide a relaxed wrist grip such that the shaft centerline is generally aligned with a user forearm centerline.

21 Claims, 2 Drawing Sheets

40
16
50
46
22
26
38

40
68
76
16
50
46
74
22
26
38

40
16
18
26
22
20
72
12
14

11
10
14
12
16

HOCKEY STICK HANDLE

CROSS-REFERENCE TO RELATED APPLICATIONS

The present application is a non-provisional of U.S. Application No. 61/112,484 filed Nov. 7, 2008.

TECHNICAL FIELD

The present invention relates generally to a handle for a hockey stick, and more particularly concerns a handle providing ergonomic and performance improvements to sport of hockey.

BACKGROUND

The derivation of the game of hockey is not entirely clear. There are some that believe that it is an evolution of stick and ball games dating back over 4000 years to Egypt. A more common and more recent evolutionary theory has modern hockey developed as an derivation of the Irish game or hurling dating from at least 1200 B.C. Modern hockey has its roots in the early $19^{th}$ century. After centuries of evolution, however, much of the sport retains its basic simplicity. Modern advances in sport technology would be well advised to retain the desirable simplicity of design while still providing improvements to player's performance.

Recent developments in sporting goods have commonly turned to the development or utilization of high tech materials. Considerable design effort has been expended to make devices stronger, lighter, more or less flexible, and more durable. The principles behind this direction in hockey innovation have lead many in the industry to believe the future of traditional hockey equipment lies in the introduction of new and improved materials to traditional designs. What the improved material theories fail to address is the fundamental limitations of the traditional designs they seek to improve. A new approach towards rethinking traditional design shapes may produce more significant improvements than the application of material sciences.

One arena in which traditional designs of hockey stick are lacking stems from a failure to apply decades of knowledge of the human body to age old designs. Often hockey sticks retain designs that are offshoots from the simple sticks from which they were originally formed. As such they largely remain straight shafts with only the most minor modifications. Players or other users must grip the straight shaft from the side. This commonly places the users wrist in a strained position which in turn hampers performance and causes undue stress on the user. In addition, a traditional side gripping stance places the centreline of the user's forearm on an angle to the centreline of the engaged shaft. This non-linear grip approach prevents the shaft from acting as a true extension of the users arm. The brain and body must compensate for the lack of linear extension constantly during usage of the shaft. This not only adds undue stress to the player but also acts a limiter to the true freedom of motion granted to human form.

It would be advantageous to have ergonomic handle design that would allow players to utilize hockey sticks with a reduction of stress as well as a more liberal freedom of motion they already experience in their own limbs.

SUMMARY OF THE INVENTION

A hockey stick handle is provided for use with a hockey stick shaft including an upper shaft surface having an upper shaft plane, a lower shaft surface having a lower shaft plane, two side shaft surfaces having side surface planes and a shaft centerline. The handle includes a shaft engagement end, a handle termination end opposite thereto, an upper handle surface, a lower handle surface comprising a lower surface spline extending inwards from the lower shaft plane towards the upper shaft plane in a first lower handle surface beginning at the shaft engagement end. The lower surface spline extending outwards in the lower shaft plane direction in a second lower handle surface beginning at the first lower handle surface and extending towards the handle termination end. A curved stop element runs between the upper handle surface towards the lower handle surface at the handle termination end and is sized to fit within a human palm. Two handle side surfaces run generally parallel to the two side shaft surfaces. The lower surface spline is configured to provide a relaxed wrist grip such that the shaft centerline is generally aligned with a user forearm centerline.

The present invention has advantages by providing a reduced user stress and increased performance efficiency during operation of the hockey stick in addition to providing an improved range of motion for the operator. The present invention accomplishes this through a unique shape that aligns the forearm with the operational stick centerline.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION

In the following description, various operating parameters and components are described for one or more constructed embodiments. These specific parameters and components are included as examples and are not meant to be limiting.

Figures 1, 2, 7, 8:
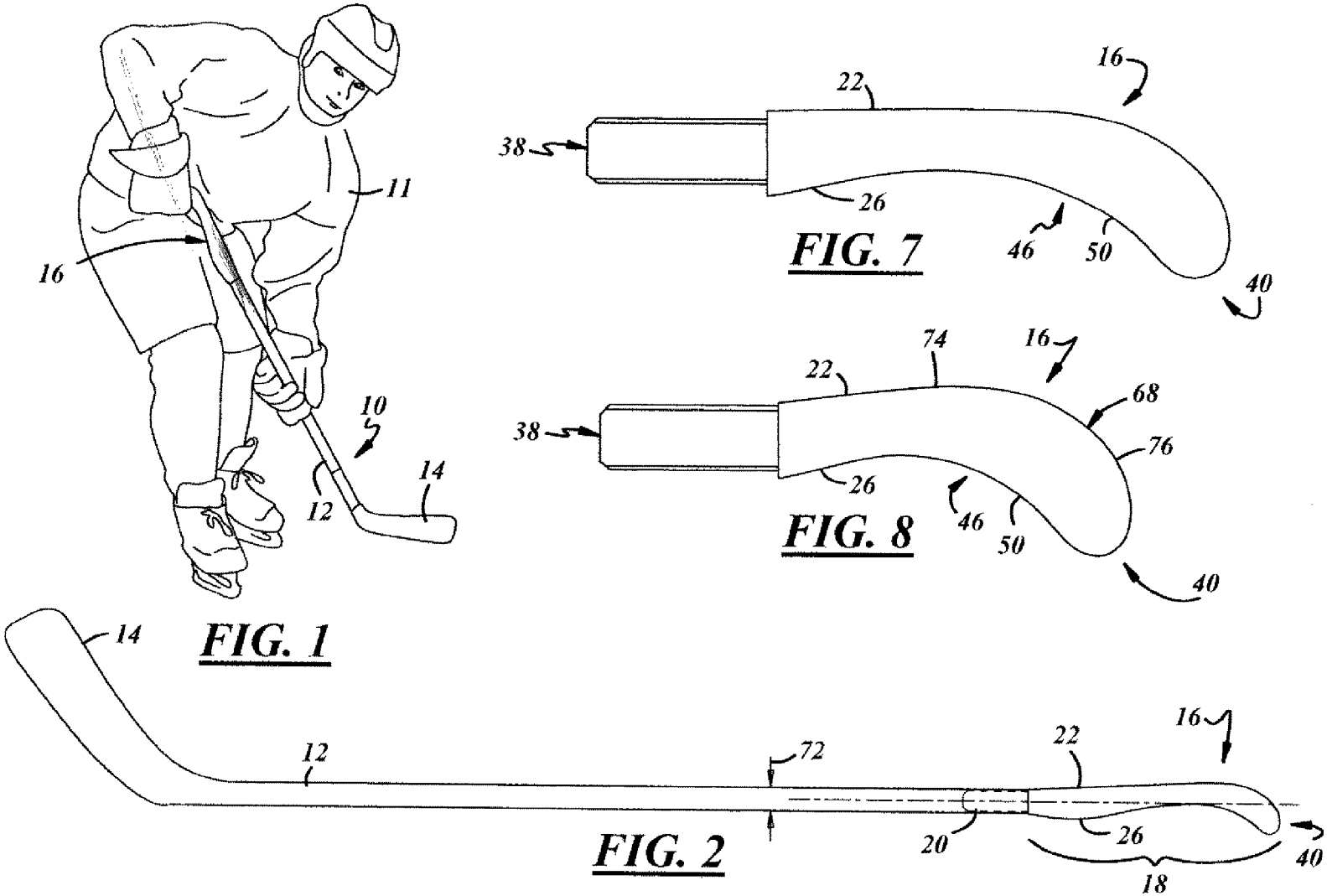
FIG. 1 is an illustration of a hockey stick handle in accordance with the present invention, the hockey stick handle illustrated gripped by a hockey player.
FIG. 2 is a detail illustration of the hockey stick handle and hockey stick illustrated in FIG. 1.
FIG. 7 is an alternate embodiment of the hockey stick handle illustrated in FIG. 1.
FIG. 8 is an alternate embodiment of the hockey stick handle illustrated in FIG. 1.
Figure 4:
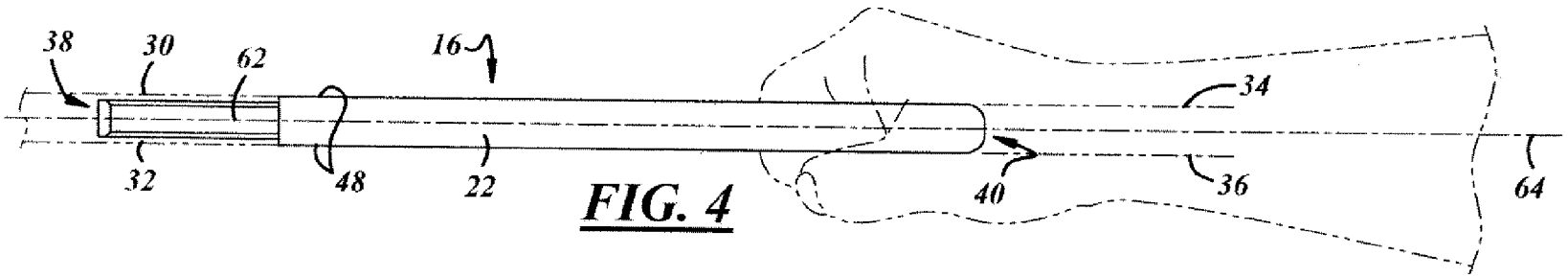
FIG. 4 is a top view of the hockey stick handle illustrated in FIG. 1.
Figure 6:
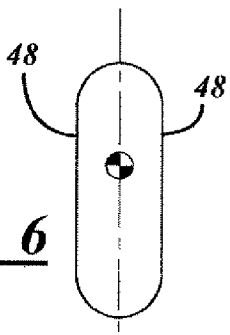
FIG. 6 is an end view of the hockey stick handle illustrated in FIG. 1.
Figure 5:
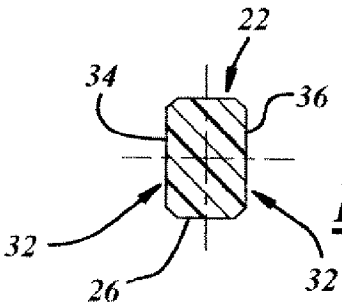
FIG. 5 is a cross sectional view of the hockey stick handle illustrated in FIG. 3.
Figure 3:
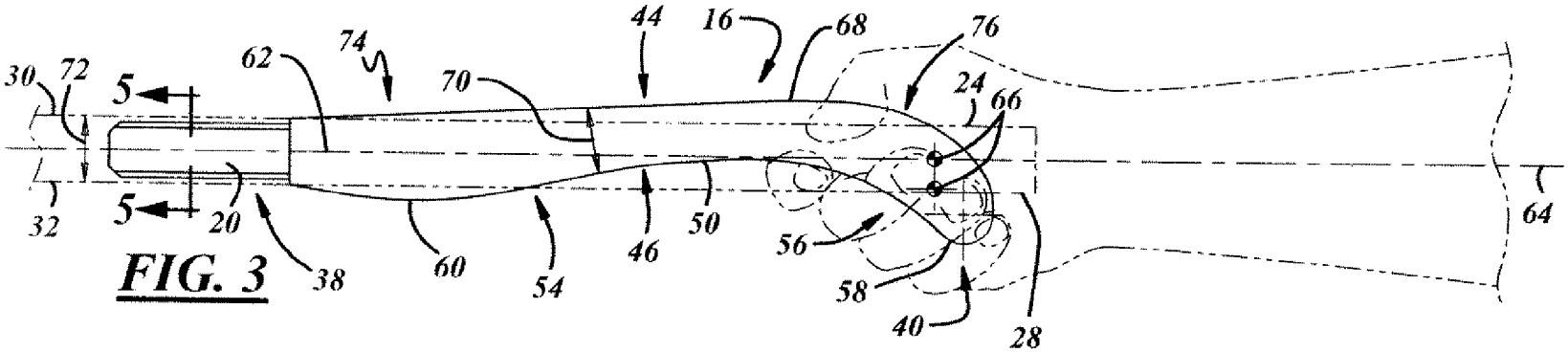
FIG. 3 is a detail illustration of the hockey stick handle illustrated in FIG. 1, the handle illustrated from a center line side view.

FIG. 1 is an illustration of a hockey stick 10 in accordance with the present invention, the hockey stick being held by a player 11 during play. The hockey stick 10 is partially conventional in that it is comprised of a shaft portion 12 and a blade portion 14 (FIG. 2). Although the shaft portion 12 may comprise a variety of shapes it is most commonly rectangular in nature. It should be further understood that the shaft portion 12 may be solid or hollow and may be comprised of a wide variety of materials as would be known to one skilled in the art. The present invention, however, significantly diverges from known hockey sticks in that if further includes an ergonomic handle 16. The ergonomic handle 16 may be formed as a unitary piece with the hockey stick 10 or may be formed as an independent element to be added to an existing hockey stick 10. As seen in FIGS. 3 and 4, the ergonomic handle 16 may be comprised of a main handle body 18 and an insert portion 20 when used with hollow shaft portions 12. When not formed as a unitary element with the shaft portion, the ergonomic handle 16 may be inserted into a shaft portion 12, secured by glue or other method, and then taped as is normally done with conventional straight shafts. It should be understood that although an insert portion 20 is illustrated, the present invention contemplates the use of a female engagement as well wherein the shaft 12 may be inserted into the handle body 18. In either case, it is contemplate that when applied to existing hockey sticks, the shaft portion 12 may be trimmed in length such that by addition of the handle body 18 the original length is maintained.

The shaft portion 12 is comprised of a an upper shaft surface 22 having an upper shaft plane 24, a lower shaft surface 26 having a lower shaft plane 28 (FIG. 3) and two side shaft surfaces 30, 32 having side surface planes 34, 36 (FIG. 4). It should be understood that the use of the term planes is for reference purposes and is not intended to limit the shaft portion 12 to flat surfaces. In the case of cylindrical or oval cross-sections it is contemplated that the planes may be referenced by the tangent of the upper most point, the lower most point, and the farthest side points respectively. As can be seen in FIGS. 3 and 4, the shaft surfaces 22,26,30,32 may be extended to provide a reference for the unique configuration of the handle body 18.

The handle body 18 is comprised of a shaft engagement end 38 and a handle termination end 40 opposite the shaft engagement end 38. The shaft engagement end 38 may include an insert portion 20 as previously described. The shaft engagement end 38 may also simply be the end of the handle body 18 wherein it merges into a uniform cross section of the shaft 12 when discussing unitary assemblies. The handle body 18 is further comprised of an upper handle surface 44, a lower handle surface 46 and two handle side surfaces 48. It is contemplated that the lower handle surface 46 is comprised of a lower surface spline 50 extending inwards from the lower shaft plane 28 towards the upper shaft plane 24 in a first lower handle surface portion 54 nearest the shaft engagement end 38. In a second lower handle surface portion 56 nearest the handle termination end 40, the lower surface spline 50 extends outwards back away from the upper shaft plane 50 so as to form a concave gripping surface. The lower surface spline 50 ends in a rounded downward protrusion portion 58 that acts as a natural stop feel during performance as well as an end grip. The rounded downward protrusion portion 58 is preferably sized to fit within a human palm such that the hockey stick 10 does not vary enough from the original shape to pose challenges to existing rules or conventions. In addition, by sizing the downward protrusion portion 58 to fit within a human palm allows an improved gripping position with increased performance and comfort. Although a purely concave lower surface spline 50 may be utilized, it is contemplated that an s-shaped lower surface spline 50 may be utilized such than an initial downward bulge 60 abuts the shaft engagement end 38 to act as a lower hand stop during performance. The lower surface spline 50 is configured such that it provides a relaxed wrist grip and such that the shaft centreline 62 is generally aligned with a user forearm centreline 64 (see FIGS. 3 and 4).

It is contemplated that the lower surface spline 50 in the second handle surface portion 56 (along with a complimentary section of the upper surface spline 68) is configured such that the users wrist is rotated less than 20 to 30 degrees (approximately) to reduce strain and improve performance. The rotation angle is preferably determined by measuring the angle of the wrist rotation about the forearm centreline 64 with zero degrees achieved when the palm center 66 is in line with the forearm centreline 64, In addition, the rounded downward protrusion portion 58 engages the approximate palm centre 66 when gripped. Although it is contemplated that the palm centre 66 will remain close to the forearm centreline 64 in one embodiment, in another it is contemplated to drop approximately 0.5 inches to accommodate a greater wrist angle. Another way to describe the same structure is that the lower surface spline 50 in the second handle surface portion 56 is configured to maintain a wrist rotation of less than 20 or 30 degrees while keeping the forearm centreline 64 parallel with the shaft centreline 62. The first handle surface portion 54 is then configured to move upwards from the shaft centreline 62 until the forearm centreline 64 is approximately in line with the shaft centreline. In still another method of describing the lower surface spline 50 is that the second handle surface portion 56 is configured for proper ease of grip and then the lower surface spline is raised until the shaft centreline 62 and the forearm centreline 64 are approximately aligned. This results in an approximate rise of four degrees of the upper surface spline 68 away from the upper shaft plane 24. These are simply additional ways of describing the unique geometry of the present invention.

It is preferable that the palm center 66 is maintained above or at the lower shaft plane 28. This both relaxes the wrist as well as bringing up the forearm centreline 64 to approximately be in line with the shaft centreline 62, An upper surface spline 68 generally parallels the lower surface spline 50 so as to maintain shaft handle depth 70 to a value suitable for gripping. Therefore the upper surface spline 68 is convex in nature extending away from the upper shaft plane 24 near the shaft engagement end 38 and returning to and dropping below the upper shaft plane 24 and the rounded downward protrusion portion 58. The upper surface spline 68 preferably extends from the upper shaft plane 24 in a direction away from the lower shaft plane 26 in a first upper handle surface portion 74 (corresponding to the first lower handle surface portion 54) and extending back in the upper shaft plane 24 direction in a second upper handle surface portion 76 (corresponding to the second lower handle surface portion 56).

The advantage of the present configuration is that it eliminates or minimizes the arc of wrist movement present in conventional handles by moving the rotation center of wrist and forearm to align with the shaft centreline 62. This drastically changes the feel and control during play such that an previously unknown range of new control is provided. It is contemplated that the downward portion 58 does not protrude below the lower shaft plane 28 by more than the original shaft depth 72 so as to not negatively impact the shaft profile. The rounded downward protrusion portion 58 and the initial downward bulge 60 act as natural stops for the users grip such that the hockey stick 10 may be passed between hands during play without concern for loss or proper hand placement. This allows a previously unknown level of ambidextrous play also never realized before in the sport. These advantages along with untold others are provided by this unique and novel ergonomic handle design. It should be understood that a wide variety of modifications would be motivated by the present disclosure.

It is further contemplated that the present invention may be scaled to afford a variety of sized players and styles. As shown in FIGS. 7 and 8, the ergonomic handle 16 may be formed in a variety of handle lengths 80 while removing the downward bulge 60 while still maintaining the combination of wrist relaxation, forearm and shaft centreline alignment, and substantially co-linear rotation of the forearm and shaft about their centrelines.

From the foregoing, it can be seen that there has been brought to the art a new and improved hockey stick handle with improved ergonomics. While the invention has been described in connection with one or more embodiments, it should be understood that the invention is not limited to those embodiments. On the contrary, the invention covers all alternatives, modifications, and equivalents as may be included within the spirit and scope of the appended claims.

What is claimed is:

1. A hockey stick handle for use with hockey stick shaft including an upper shaft surface having an upper shaft plane, a lower shaft surface having a lower shaft plane, two side shaft surfaces having side surface planes, a shaft depth and a shaft centerline, the hockey stick handle comprising:

a shaft engagement end;

a handle termination end opposite said shaft engagement end;

a upper handle surface;

a lower handle surface comprising a lower surface spline, said lower surface spline extending inwards uniformly and smoothly without abrupt portions in the direction of the lower shaft plane towards an upper surface plane in a first lower handle surface portion beginning at said shaft engagement end, said lower surface spline extending outwards uniformly and smoothly without abrupt portions in a direction back towards the lower shaft plane in a second lower handle surface portion beginning at said first lower handle surface portion and extending towards said handle termination end;

an upper surface spline extending uniformly and smoothly without abrupt portions from the upper shaft plane in a direction away from the lower shaft plane in a first upper handle surface portion and extending uniformly and smoothly without abrupt portions back in the upper shaft plane direction in a second upper handle surface portion;

a rounded downward protrusion portion running between said upper handle surface towards said lower handle surface at said handle termination end; and two handle side surfaces running generally parallel to the two side shaft surfaces;

wherein said upper and lower surface splines are configured to provide an ergonomic wrist grip such that the shaft centerline is generally aligned with a user forearm centerline.

2. The hockey stick handle according to claim 1 wherein:

said rounded downward protrusion portion configured to point generally in a lower shaft plane direction, said rounded downward protrusion protruding past the lower shaft plane for a distance less than the shaft depth.

3. The hockey stick handle according to claim 1 wherein said shaft engagement end is configured to engage a hockey stick.

4. The hockey stick handle according to claim 1 wherein said rounded downward protrusion portion is sized to fit within a human palm.

5. The hockey stick handle according to claim 1 wherein said lower surface spline is configured to generate a wrist rotation of less than 20 degrees when gripped.

6. The hockey stick handle according to claim 1 wherein second lower handle surface portion generates a palm centre at or above the lower shaft plane.

7. The hockey stick handle according to claim 1 wherein said lower surface spline is configured to generate a related wrist grip angle less than 30 degrees and a palm centre less than 0.5 inches below the shaft centreline.

8. The hockey stick handle according to claim 1, wherein said first lower handle surface portion includes an initial downward bulge.

9. The hockey stick handle according to claim 1 wherein said rounded downward protrusion portion has an upper surface portion which comprises a convex continuous curved portion, and a lower surface portion which comprises a concave continuous curved portion.

10. An ergonomic hockey stick comprising:

a hockey shaft including an upper shaft surface having an upper shaft plane;

a lower shaft surface having a lower shaft plane, said upper shaft plane and said lower shaft plane defining a shaft depth;

two side shaft surfaces having side surface planes;

a shaft centerline; and an ergonomic handle comprising:

a shaft engagement end;

a handle termination end opposite said shaft engagement end;

an upper handle surface;

a lower handle surface comprising a lower surface spline, said lower surface spline extending inwards uniformly and smoothly without abrupt portions from the lower shaft plane towards an upper surface plane in a first lower handle surface beginning at said shaft engagement end, said lower surface spline extending outwards uniformly and smoothly in the lower shaft plane direction in a second lower handle surface beginning at said first lower handle surface and extending towards said handle termination end;

an upper surface spline extending uniformly and smoothly without abrupt portions from the upper shaft plane in a direction away from the lower shaft plane in a first upper handle surface portion and extending uniformly and smoothly without abrupt portions back in the upper shaft plane direction in a second upper handle surface portion;

a rounded downward protrusion running between said upper handle surface towards said lower handle surface at said handle termination end; and two handle side surfaces running generally parallel to the two side shaft surfaces;

wherein said second handle surface portion is configured to provide a relaxed wrist grip and forearm centerline approximately parallel to said shaft centerline, and said first handle surface portion is configured to raise said user forearm centerline until it is approximately coincident with said shaft centerline.

11. The ergonomic hockey stick according to claim 10, wherein said rounded downward protrusion is sized to fit within a human palm.

12. The ergonomic hockey stick according to claim 10, wherein:

said rounded downward protrusion portion is configured to point generally in a lower shaft plane direction, said rounded downward protrusion protruding past the lower shaft plane for a distance less than said shaft depth.

13. The ergonomic hockey stick according to claim 10, wherein said lower surface spline is configured to generate a wrist rotation of less than 20 degrees when gripped.

14. The ergonomic hockey stick according to claim 10, wherein second lower handle surface portion generates a palm centre at or above said lower shaft plane.

15. The ergonomic hockey stick according to claim 10, wherein said first lower handle surface portion includes an initial downward bulge.

16. The hockey stick handle according to claim 10 wherein said rounded downward protrusion portion has an upper surface portion which comprises a convex continuous curved portion, and a lower surface portion which comprises a concave continuous curved portion.

17. A method of shaping a hockey stick handle comprising:

configuring a hockey stick handle to have a shaft engagement end for engaging a hockey stick shaft having a shaft centerline, a handle termination end, an upper handle surface, and a lower handle surface;

configuring said lower handle surface to comprise a lower surface spline, said lower surface spline curving upwards uniformly and smoothly without abrupt portions in a first lower handle surface portion beginning at said shaft engagement end and curving downwards uniformly and smoothly without abrupt portions in a second lower handle surface portion ending at said handle termination end;

configuring said upper handle surface to extend uniformly and smoothly without abrupt portions from the upper shaft plane in a direction away from the lower shaft plane in a first upper handle surface portion and extending uniformly and smoothly without abrupt portions back in the upper shaft plane direction in a second upper handle surface portion;

configuring said lower surface spline at said second handle surface such that by gripping said second handle surface a forearm centerline is in the same direction as said shaft centerline;

and configuring said lower surface spline at said first handle surface such that when gripping said second handle surface the forearm centerline is coincident with said shaft centerline.

18. A method as described in claim 17, wherein said lower surface spline is configured to generate a wrist rotation of less than 20 degrees when gripped.

19. A method as described in claim 17, further comprising:

configuring said hockey stick handle to include a rounded downward protrusion portion running between said upper handle surface towards said lower handle surface at said handle termination end.

20. A method as described in claim 17, wherein second lower handle surface portion generates a palm centre at or above the lower shaft plane.

21. A hockey stick comprising:

a hockey stick shaft including an upper shaft surface having an upper shaft plane;

a lower shaft surface having a lower shaft plane, said upper shaft plane and said lower shaft plane defining a shaft depth;

two side shaft surfaces having side surface planes;

a shaft centerline; and a hockey stick handle comprising:

a shaft engagement end;

a handle termination end opposite said shaft engagement end;

an upper handle surface;

a lower handle surface comprising a lower surface spline, said lower surface spline extending inwards uniformly and smoothly without abrupt portions from the lower shaft plane towards an upper surface plane in a first lower handle surface beginning at said shaft engagement end, said lower surface spline extending outwards uniformly and smoothly without abrupt portions in the lower shaft plane direction in a second lower handle surface beginning at said first lower handle surface and extending towards said handle termination end;

an upper surface spline extending uniformly and smoothly without abrupt portions from the upper shaft plane in a direction away from the lower shaft plane in a first upper handle surface portion and extending uniformly and smoothly without abrupt portions back in the upper shaft plane direction in a second upper handle surface portion;

a rounded downward protrusion running in a constant downward direction between said upper handle surface and said lower handle surface at said handle termination end;

and two handle side surfaces running generally parallel to the two side shaft surfaces;

wherein said second handle surface portion is configured to provide a relaxed wrist grip and forearm centerline approximately parallel to said shaft centerline, said rounded downward protrusion configured to be contained within a users palm when said relaxed wrist grip is achieved and said forearm centerline is parallel to said shaft centerline, and said first handle surface portion is configured to raise said user forearm centerline until it is approximately coincident with said shaft centerline while maintaining a wrist rotation of less than 30 degrees.

* * * * *